US005438805A

United States Patent [19]

McCrary

[11] Patent Number: 5,438,805

[45] Date of Patent: Aug. 8, 1995

[54] DEVICE FOR RAISING AND LOWERING ELONGATED SUPPORT STRUCTURES

[76] Inventor: Charles R. McCrary, R.R. 1, Box 25, Estill, S.C. 29918

[21] Appl. No.: 106,828

[22] Filed: Aug. 16, 1993

[51] Int. Cl.[6] ..... B66C 23/06

[52] U.S. Cl. ..... 52/116; 248/514

[58] Field of Search ..... 248/514, 654; 52/116, 52/121, 117, 119

[56] References Cited

U.S. PATENT DOCUMENTS

| | | | |
|---|---|---|---|
| 3,322,378 | 5/1967 | Thompson | 248/654 X |
| 3,778,940 | 12/1973 | Blecken | 52/116 |
| 3,992,831 | 11/1976 | Bukovitz | 52/117 X |
| 4,088,289 | 5/1978 | Wood | 52/116 X |
| 4,297,815 | 11/1981 | Moro | 52/116 X |
| 4,616,454 | 10/1986 | Ballachey | 52/116 X |
| 4,903,442 | 2/1990 | Trommem | 52/116 |
| 5,058,336 | 10/1991 | Jenvey | 52/119 X |
| 5,269,107 | 12/1993 | Klemm | 52/116 X |

FOREIGN PATENT DOCUMENTS

| | | | |
|---|---|---|---|
| 1196606 | 11/1963 | Germany | 52/116 |

*Primary Examiner*—J. Franklin Foss

*Attorney, Agent, or Firm*—B. Craig Killough

[57] ABSTRACT

A device for raising and lowering a pole or other elongated support structure has a stand on which the elongated support structure is mounted. The stand is pivotally connected to a base. An actuator, such as an hydraulically actuated cylinder, raises and lowers the elongated support structure by the use of a control rod which is connected to the stand and to the actuator, and which traverses to cause the stand to pivot relative to the base to raise and lower the support structure.

6 Claims, 4 Drawing Sheets

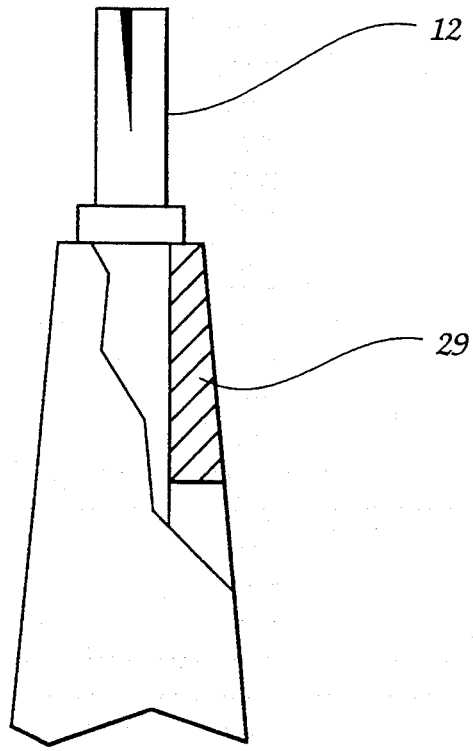
Fig. 4
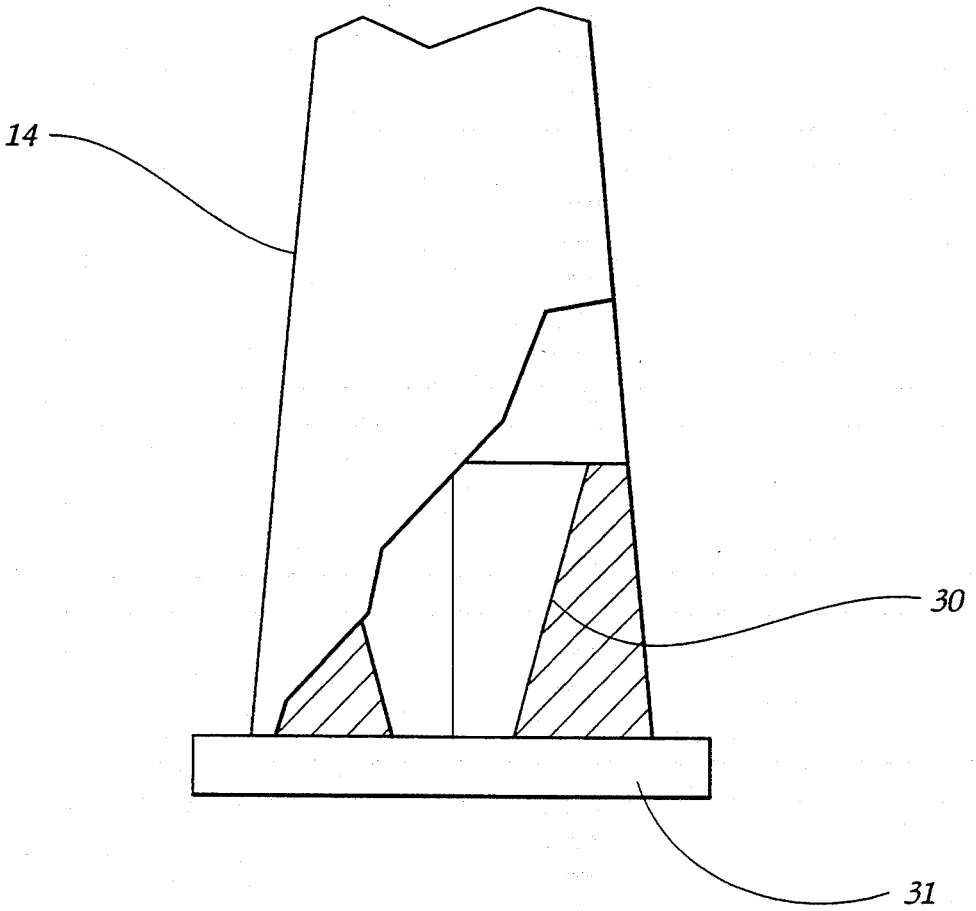

DEVICE FOR RAISING AND LOWERING ELONGATED SUPPORT STRUCTURES

FIELD OF THE INVENTION

This invention relates generally to poles or similar elongated support structures, and is more specifically directed to a device for raising and lowering a pole or elongated support structure.

BACKGROUND OF THE INVENTION

Poles and similar devices such as masts are used for many functions. Poles are elongated members which are vertically positioned, or otherwise mounted for the purpose of elevating some device or member mounted to the pole. Common examples of poles are flag poles, telephone poles, antenna masts, and sailboat masts. Poles and masts are common examples of elongated support structures, although there are other similar elongated support structures.

Poles and masts are used to support various devices. These devices may be flags, wires, transformers, antennae, irrigation or similar liquid distribution equipment, hoists, or any other article which is elevated.

In the case of many forms of masts or poles, halyards are used to raise and lower articles. In the case of flags and sails, halyards work adequately to raise and lower the articles which are affixed to the flag pole or mast.

Other articles which are supported by poles or masts are more permanently affixed to the pole or mast. For example, a transformer on a telephone pole must be solidly affixed, and not subject to wind and other weather conditions. Accordingly, a halyard would not adequately position a transformer on a pole. Irrigation equipment commonly uses rotating spray nozzles, and such equipment must be affixed to the pole to accommodate the dynamics of the equipment.

Most poles and masts must be rigidly affixed to their support, or to the ground. A tall pole having a working device at the top thereof potentially creates a great moment about the base of the mast. As the pole increases in length, the greater the requirement for support at the base of the pole.

At the same time, it is desirable to easily access the object device which is affixed to the pole. If a rotating spray nozzle needs repair or replacement, access must be available to the spray nozzle. Either the pole must be taken down or a worker must be lifted to the top of the pole. While devices such as cherry pickers can lift a worker to the top of a pole, these devices are expensive.

Alternatively, means may be provided for a worker to climb or otherwise be hoisted to the top of the mast or pole. Such an arrangement increases the need for structural stability of the pole, and presents a substantial safety hazard to the worker.

Masts and poles which are affixed to the ground are normally buried, and are frequently set in concrete. When the pole is secured by setting the pole in concrete, lowering the pole for repair to the pole or the object device that is mounted on the pole presents a major operation.

Ideally, a pole or mast is securely mounted by burying the base of the pole and setting it in concrete, while providing a convenient mechanism for raising and lowering the pole or mast as desired.

SUMMARY OF THE PRESENT INVENTION

The present invention provides a base which may be securely and permanently mounted. The base may be welded, bolted or otherwise affixed to any other mechanism, such as a vehicle. The base may be buried in the earth and/or set in concrete. A stand is pivotally mounted to the base, with a pivot point near one end of the stand. A means is provided to removably secure the stand to the base. A means, such as a hydraulic cylinder is attached to the stand. A control rod of the cylinder traverses to cause the stand to pivot about the pivot point. An elongate support structure, such as a pole or a mast is affixed to the stand, and as the stand pivots, the pole is moved from a vertical position to a horizontal position, meaning that the object device which is attached to the support structure may be easily accessed for repair, replacement or otherwise.

DESCRIPTION OF THE DRAWINGS

FIG. 4 is a cross-section of the elongated support structure.

DETAILED DESCRIPTION OF THE PREFERRED EMBODIMENT

Figure 1:
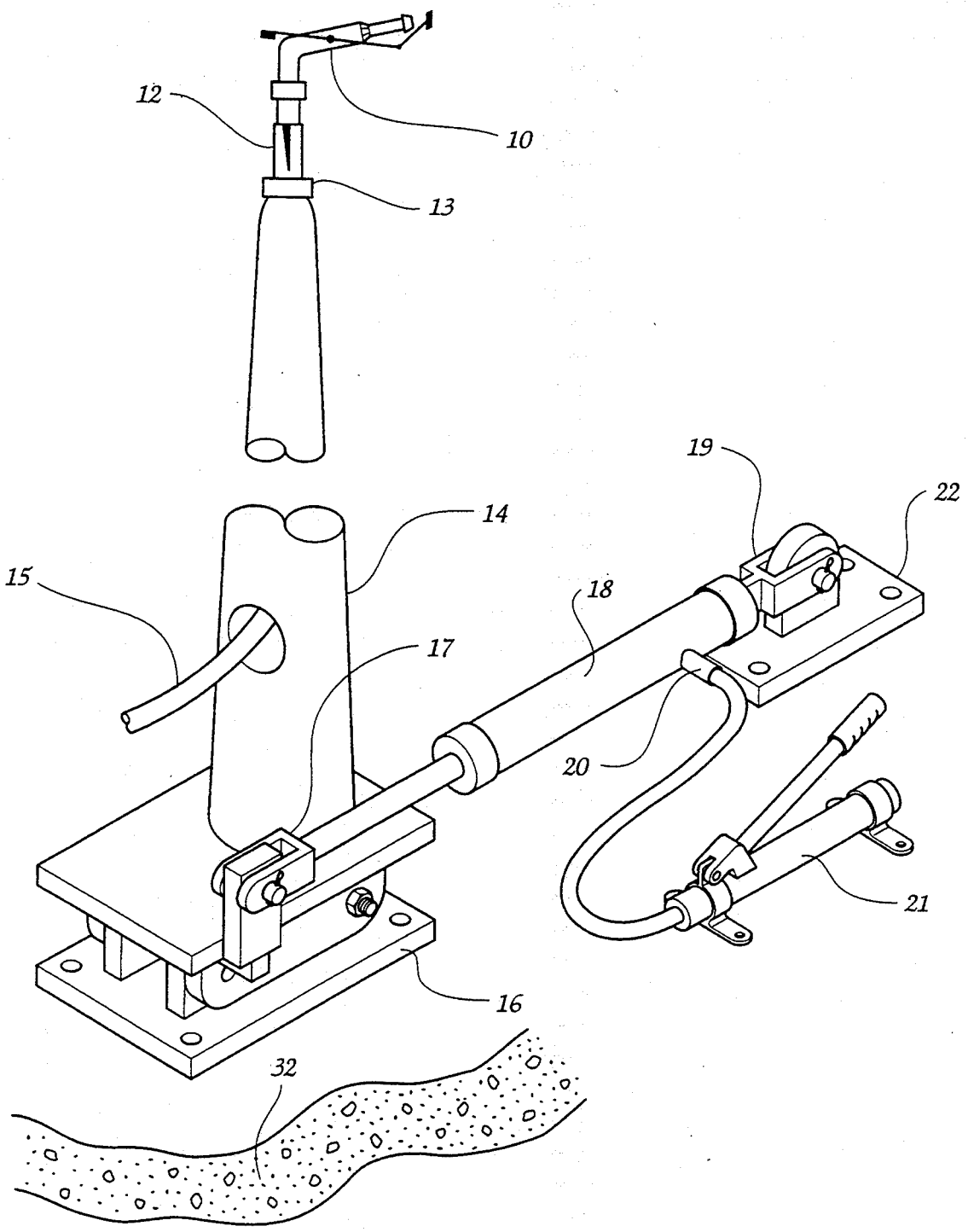
FIG. 1 is a perspective view of the device.

Referring now to the drawing figures, FIG. 1 depicts the elongated support structure 14 mounted to the stand 32. The stand is pivotally mounted to the base 16. The base is fixed by, for example, setting it in concrete 33.

Figure 2:
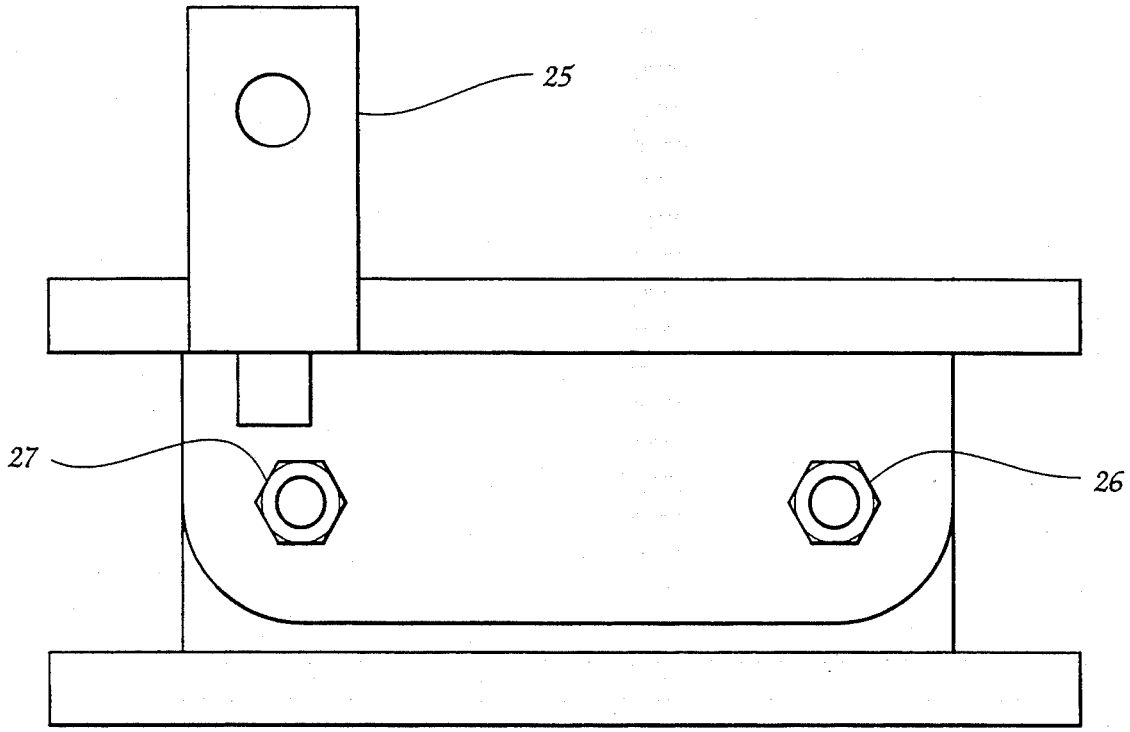
FIG. 2 is a side elevation of the base and stand.
Figure 3:
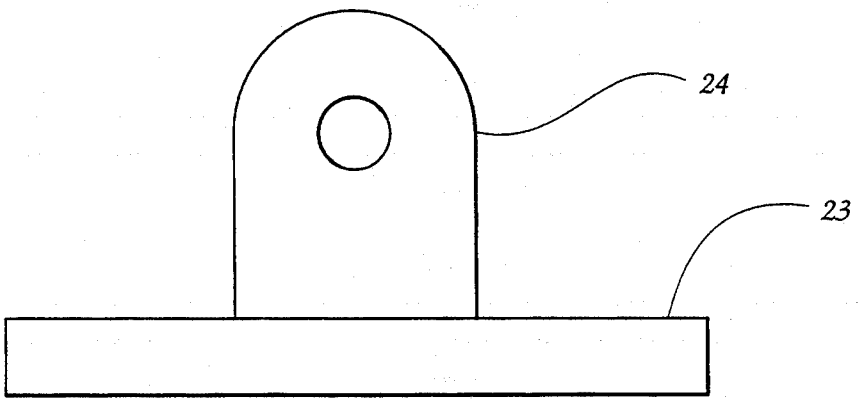
FIG. 3 is a side elevation of the mounting plate.
Figure 5:
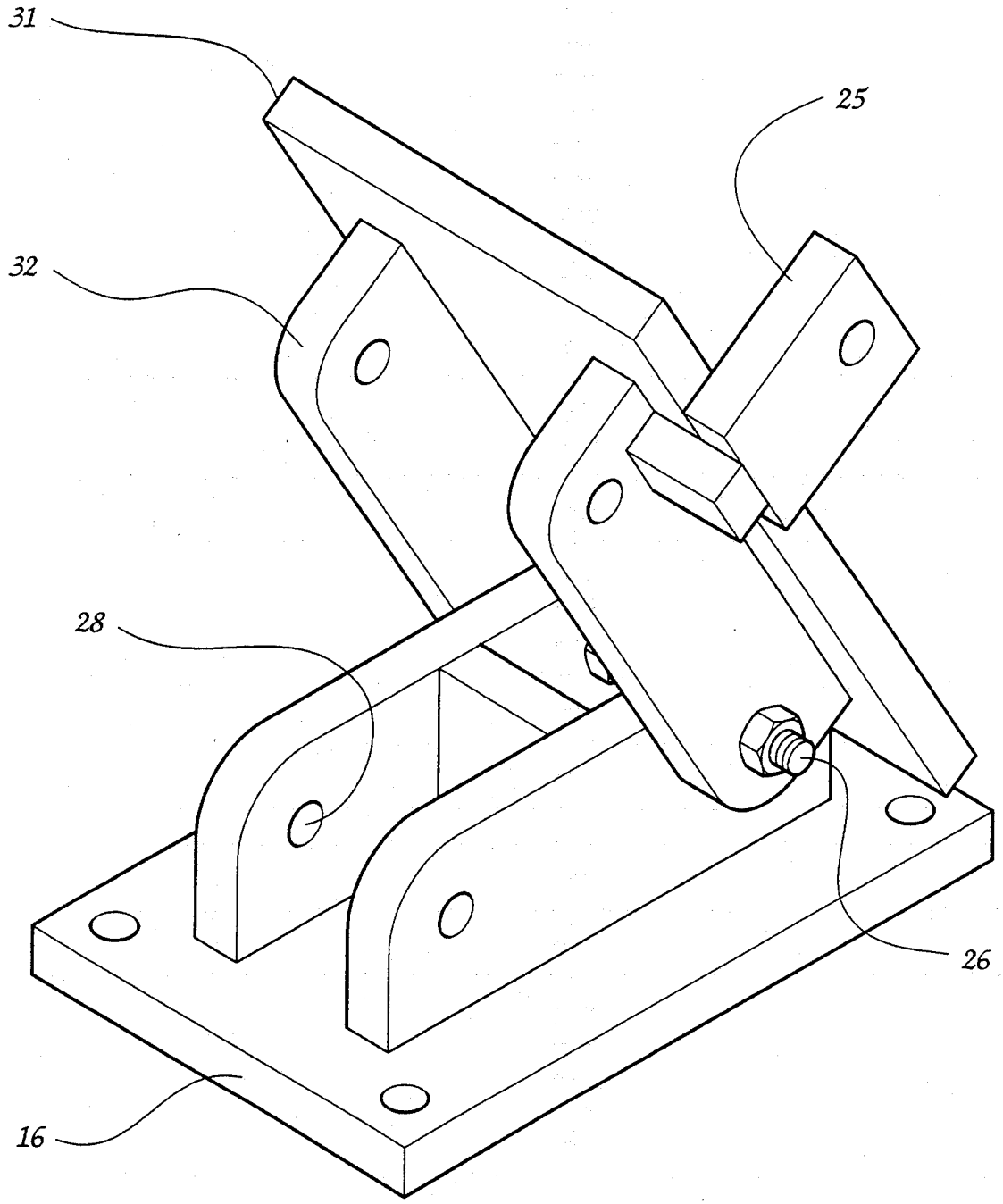
FIG. 5 is a perspective view of the base and stand demonstrating pivoting of the stand relative to the base.

The base is of sufficient structure to support the elongated support structure. The base may be mounted in various ways, such as by mounting it to a vehicle, or by attaching it to an anchoring device and setting it in the ground with concrete. The base may be mounted to any device which will provide adequate support for the elongated support structure. The stand is pivotally mounted to the base. The stand is pivotally mounted to the base wherein the pivot point 26 is displaced from the center of the base of the pole as demonstrated in FIG. 5. In most applications, it is anticipated that the pivot point will be near one end of the base as shown in FIG. 5. The pivot point must be located so that the plate 31 of the stand can pivot from the horizontal plane of FIG. 2 to the near vertical plane of FIG. 5. Accordingly, the pivot point must be such that the plate is not interfered with as it travels from the horizontal plane to the vertical plane, and must be far enough away from center to allow desired movement.

Means is provided to cause pivoting of the stand. The elongate support structure and object device may weigh several hundred pounds, and accordingly, it is necessary to be able to cause the stand to pivot in a controlled fashion. The actuation means must have sufficient power and sufficient mechanical power to rotate the plate of the stand from the horizontal plane to the vertical plane, while also controlling the velocity at which the plate rotates. The velocity of the top of a particularly long support structure is much greater than the velocity of the stand as it rotates.

In the preferred embodiment, a hydraulic cylinder 18 is used to rotate the stand. The hydraulic cylinder has a control rod which extends from the cylinder as hydraulic pressure is applied to the piston and control rod in the cylinder. The control rod contracts into the cylinder as pressure is relieved, rotating the stand to vertical position. Any other means which will apply a force to the stand to cause it to rotate relative to the base may be used. In certain applications, a pneumatic cylinder may be used.

The point of attachment of the actuation means to the stand should achieve a mechanical advantage. The point of attachment is typically near an end of the stand which is opposite the end on which the pivot point 26 is located. The actuation means, such as the hydraulic cylinder, may be attached as shown in FIG. 1. The end of the control rod is attached by pivotal means to the dog 25 which is extends from the stand. The hydraulic cylinder is shown as extended in FIG. 1 and is positioned behind the stand near pivot point 26, and opposite the point of connection of the control rod to the dog 25. The opposite end of the hydraulic cylinder is pivotally attached to a mounting plate 22. The mounting plate will be securely affixed similarly to the base, in most cases. The mounting plate could be affixed to a device such as a vehicle, or to the ground. It may be desirable to remove the cylinder and the mounting plate after the elongate support structure is vertically positioned for use, and accordingly, the mounting plate may be removably anchored.

The elongate support member is securely affixed to the stand. An object device may be affixed as desired to the support structure. As shown in FIG. 1, the object device is a rotating spray nozzle 10. The object device may be any other device or structure which is to be attached to the support structure.

In use, the device may be positioned so that the elongate support structure is generally horizontal with the plate in the generally vertical plane. The hydraulic cylinder or other actuation means is actuated to pivot the plate towards its horizontal plane, thereby raising the elongate support structure. As shown in FIG. 1, the rod from the hydraulic cylinder will extend, pushing the stand to the position shown in FIG. 1. The stand will come to rest against the base.

After the support structure is positioned as desired, the stand may be secured such as by inserting a nut and bolt 27 through a void 28 which is opposite the pivot point. If desired, the actuation means may be removed. The elongate support structure is secured to the mounted base to which the stand is attached.

The pivot means may be any known pivot means. Any sort of axle assembly may be used.

The elongate support structure may be any structure which is capable of being mounted on a pivoting stand of the type described. The elongated support structure may be a single pole, which is solid, such as a wooden telephone or utility pole, or a hollow fiberglass or metal pole. The structure could comprise a plurality of poles or masts. If the structure is hollow, service lines 15, such as water lines, may be inserted through the center of the pole to deliver energy or materials to, for example, the object device.

What is claimed is:

1. A device for raising and lowering elongated support structures, comprising:

a. a base;

b. a stand which is pivotally connected to said base near one end of said stand by means of a pivotal connection;

c. an elongated support structure which is fixed to said stand; and d. an actuator means which has a control rod which extends generally horizontally from an end of said actuator means when said support structure is in a generally vertical position, wherein said control rod extends from said actuator means past said pivotal connection of said stand to said base and extends past said elongated support structure and is pivotally attached to said stand at a point of said stand which is opposite said support structure from said actuator means, wherein said control rod traverses and pulls said stand so as to cause said stand to pivot relative to said base and to move said stand from a vertical position to a horizontal position and which traverses in an opposite direction and pushes said stand to move said stand from a horizontal position to a vertical position.

2. A device for raising and lowering elongated support structures as described in claim 1, wherein said actuator means is an hydraulically actuated cylinder.

3. A device for raising and lowering elongated support structures as described in claim 1, wherein said cylinder is a pneumatically actuated cylinder.

4. A device for raising and lowering elongated support structures, comprising:

a. a base;

b. a stand which is pivotally connected to said base near one end of said stand by means of a pivotal connection;

c. an elongated support structure which is fixed to said stand;

d. an actuator mounting; and e. an actuator means which is pivotally mounted on one end to said actuator mounting and which has a control rod which extends generally horizontally from an opposite end of said actuator means, wherein said control rod extends from said actuator past said pivotal connection of said stand to said base and extends past said elongated support structure and is pivotally attached to said stand at a point of said stand which is opposite support structure from said actuator mounting, wherein said control rod traverses and pulls said stand so as to cause said stand to pivot relative to said base and to move said stand from a vertical position to a horizontal position and which traverses in an opposite direction and pushes said stand to move said stand from a horizontal position to a vertical position.

5. A device for raising and lowering elongated support structures as described in claim 4, wherein said actuator means is a hydraulically actuated cylinder.

6. A device for raising and lowering elongated support structures as described in claim 4, wherein said actuator means is a pneumatically actuated cylinder.

* * * * *